US008499802B2

(12) United States Patent
Falckenberg et al.

(10) Patent No.: US 8,499,802 B2
(45) Date of Patent: Aug. 6, 2013

(54) FUEL PUMP NOZZLE WITH MANUALLY OPERATED SWITCH LEVER AND HOLD-OPEN AID

(75) Inventors: Harald Falckenberg, Hamburg (DE); Ulrich Meyer, Hamburg (DE)

(73) Assignee: Elaflex-Gummi Ehlers GmbH, Hamburg (DE)

( * ) Notice: Subject to any disclaimer, the term of this patent is extended or adjusted under 35 U.S.C. 154(b) by 641 days.

(21) Appl. No.: 12/619,901

(22) Filed: Nov. 17, 2009

(65) Prior Publication Data

US 2010/0126626 A1 May 27, 2010

(30) Foreign Application Priority Data

Nov. 17, 2008 (EP) ..... 08020004

(51) Int. Cl.
*B65B 1/30* (2006.01)

(52) U.S. Cl.
USPC ..... 141/218; 141/206; 251/90

(58) Field of Classification Search
USPC ..... 141/206, 208, 218, 392; 251/90
See application file for complete search history.

(56) References Cited

U.S. PATENT DOCUMENTS 3,323,560 A * 6/1967 Ehlers ..... 141/208
5,067,533 A * 11/1991 Carder et al. ..... 141/392
5,469,900 A * 11/1995 Weeks et al. ..... 141/392

FOREIGN PATENT DOCUMENTS

DE 1226904 * 10/1966

* cited by examiner

*Primary Examiner* — Jason K Niesz
(74) *Attorney, Agent, or Firm* — Browdy and Neimark, P.L.L.C.

(57) ABSTRACT

A fuel pump nozzle for delivering fuel, with a manually operated switch lever which is movable between a closed position, in which there is no delivery of fuel, and an open position, in which fuel is delivered, wherein the switch lever is biased by a restoring spring in the direction of the closed position and automatically returns to the closed position when the manual force applied declines, wherein the pump nozzle is provided with a hold-open aid which reduces the force required to hold the switch lever in a particular open position compared to the forces required to hold the switch lever open in other open positions.

14 Claims, 2 Drawing Sheets

FUEL PUMP NOZZLE WITH MANUALLY OPERATED SWITCH LEVER AND HOLD-OPEN AID

Figure 1:
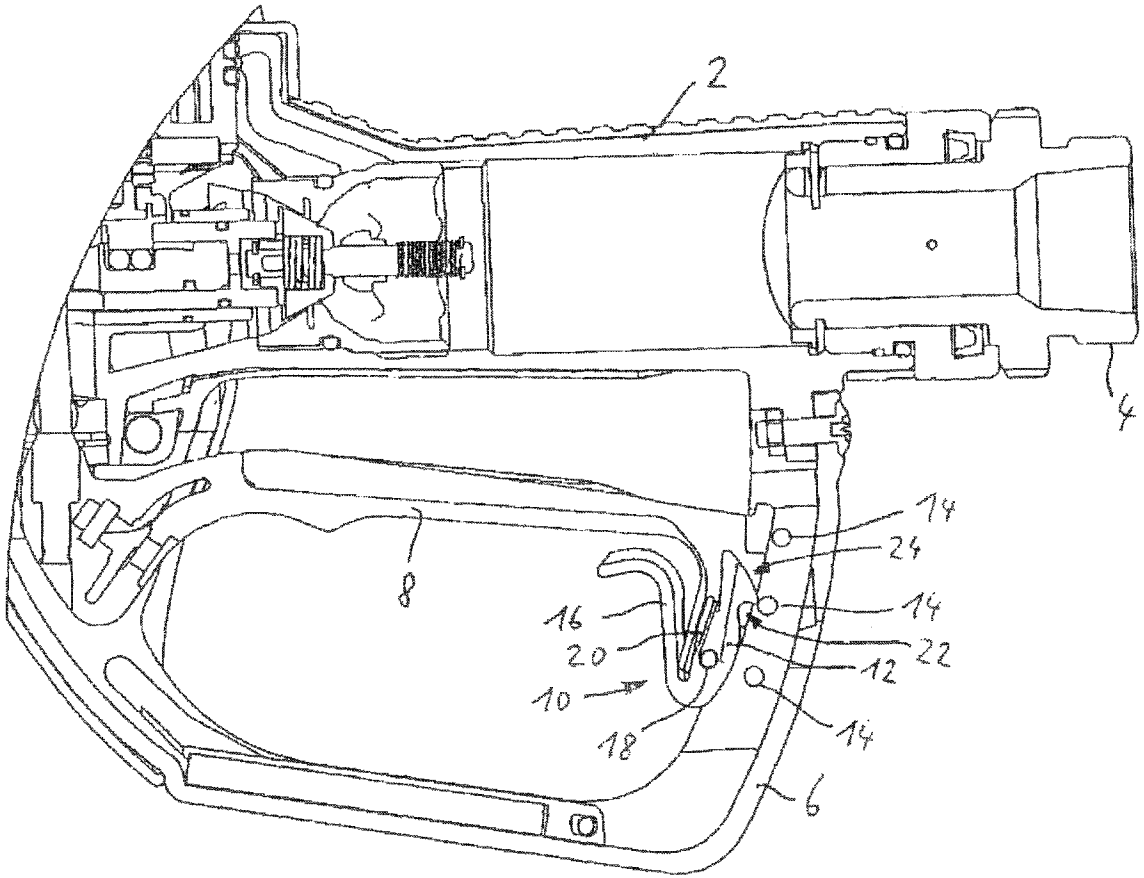

The invention relates to a fuel pump nozzle for delivering fuel, with a manually operated switch lever which is movable between a closed position, in which there is no delivery of fuel, and an open position, in which fuel is delivered, wherein the switch lever is biased by a restoring spring in the direction of the closed position and automatically returns to the closed position when the manual force applied declines.

Automatic fuel pump nozzles of this kind for the delivery of fuels at filling stations are operated by having to pull the switch lever, or trigger, by hand. The switch lever opens a spring-biased valve, so that, depending on the spring forces set, the user has to apply a force to the switch lever. That force acts throughout the entire filling process, which can take several minutes, depending on the flow rate and the size of the fuel tank. In order not to have to apply this force by hand throughout the entire filling process, there are latch systems on the fuel pump nozzles, by means of which, after the switch lever has been pulled, the switch lever can be latched in one or more positions. As a rule, there is an automatic control system present to switch off the fuel pump nozzle, which is designed in such a way that the latch can be cancelled by the automatic switch-off system.

In some countries, however, the latching possibility described above cannot be used, because of various requirements, since it is required that the fuel pump nozzle must in any case close automatically whenever the force exerted by the hand is removed, i.e. possibly even before the automatic cut-off when the tank is full.

The problem of the invention consists in improving a fuel pump nozzle of the generic kind in such a way that it is not necessary to maintain the switch lever force by hand throughout the entire filling process.

This problem is solved in accordance with the invention in a fuel pump nozzle of the generic kind by means of the measure that the fuel pump nozzle is provided with a hold-open aid which reduces the force required to hold the switch lever in a particular open position compared to the forces required to hold the switch lever open in other open positions.

After the switch lever has been pulled by hand, the hold-open aid thus takes over the greater part of the holding force required for holding the switch lever open during the filling process, in one or more predetermined open positions selected in advance, so that the hand force required in these open positions is reduced considerably compared to the manual force required in other open positions of the switch lever.

It is proposed that the hold-open aid should preferably reduce a necessary hold-open force not just in one, but in several predetermined open positions, for example in a first predetermined open position, in which the delivery of fuel occurs at a minimum flow rate, a second predetermined open position, in which the delivery of fuel occurs at a medium flow rate, and a third predetermined open position, in which the delivery of fuel occurs at a maximum flow rate.

The hold-open aid can include a hold-open member that can be moved between a latched position and a released position, which, in the latched position, can co-operate with a fixed hold-open catch connected, for example, to a pump nozzle housing, the position of which defines the predetermined open position.

The latch member can be spring-biased towards the latched position or away from it.

It is preferably proposed that the latch member is designed as a pivotable lever.

The lever may include a release actuating surface for co-operating with a hold-open catch, and it may include a latching surface for co-operating with a hold-open catch.

The latching surface can be designed with an undercut so that, even when the force acting on the lever is relatively low, a noticeable relief effect is achieved with regard to the manual hold-open force required for the switch lever.

The latch member may include a hold-open portion which an operating person can actuate with one finger. The hold-open portion may be designed as a further arm of the lever.

It is convenient to provide two, three or more hold-open catches, which are preferably connected to a pump nozzle housing, for example by being fixed to a trigger guard of the pump nozzle housing.

It is convenient for a first hold-open catch to define an open position with a minimum fuel throughput, for a second hold-open catch to define an open position with a medium fuel throughput, and for a third hold-open catch to define an open position with a maximum fuel throughput.

In one variant, it can be provided that the latch member is designed as a latching tappet guided so as to move linearly along the switch lever, which can be moved, via two spring-biased lever members connected to a common articulation point, to a latched position in a predetermined open position of the switch lever, in which it co-operates indirectly or directly with the pump nozzle housing.

Figure 2:
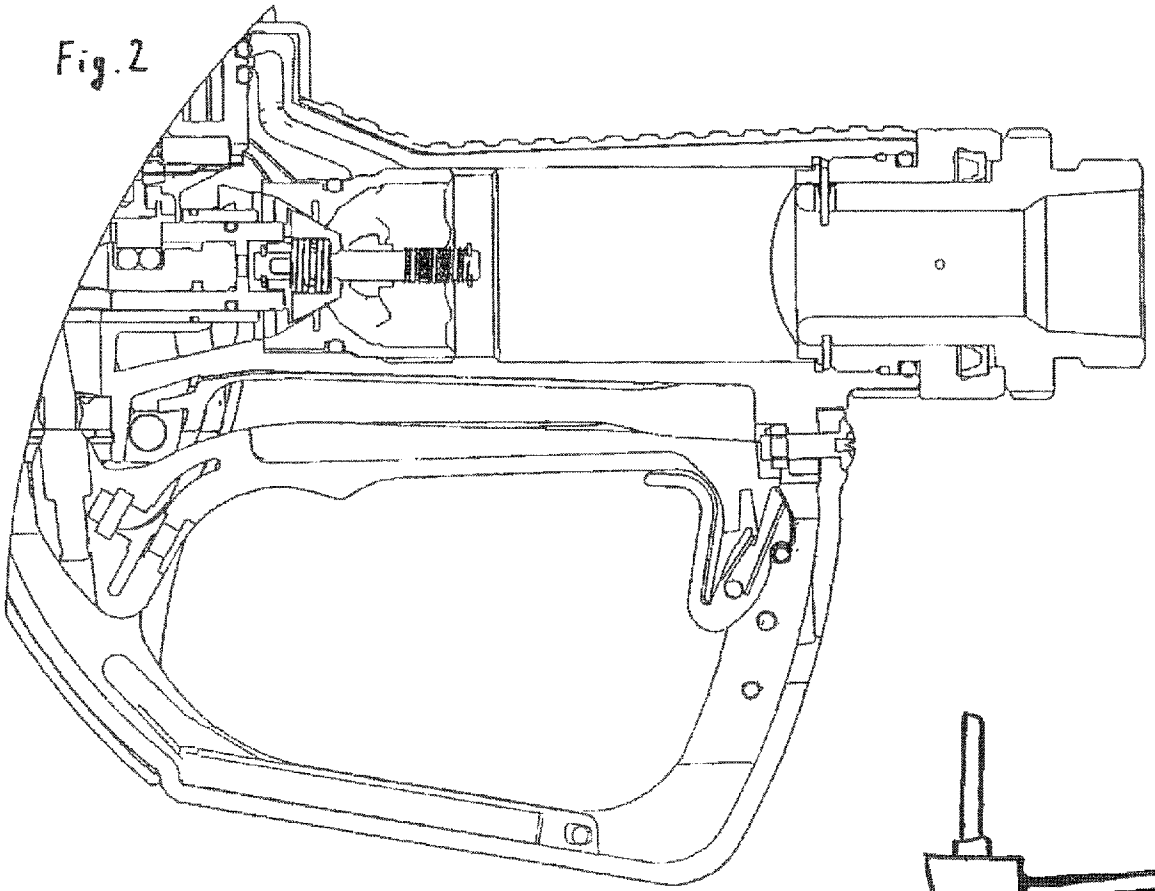
Figure 3:
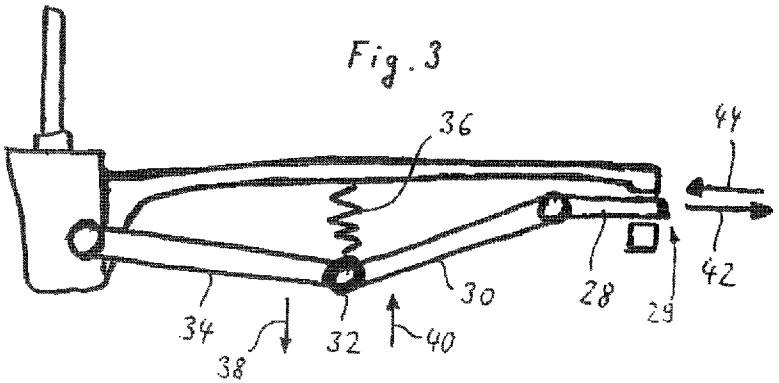

Further advantages and features of the invention will become clear from the following description of worked embodiments, reference being made to a drawing in which FIG. 1 shows a section of a fuel pump nozzle in accordance with the invention, FIG. 2 shows the fuel pump nozzle according to FIG. 1 in a different switch lever position, and FIG. 3 shows a variant of the fuel pump nozzle according to FIG. 1;

FIGS. 1 and 2 illustrate the invention in the form of an automatic fuel pump nozzle for the delivery of fuels at filling stations, though the drawing only illustrates part of such a fuel pump nozzle in a schematic section view. A pump nozzle housing 2 can be seen with a pump hose connection 4, a trigger guard 6 firmly connected to the pump nozzle housing and a switch lever 8 pivotably mounted inside a space surrounded by the trigger guard 6. The switch lever 8 can be moved by hand in a manner which is known per se between a closed position, in which there is no delivery of fuel, and an open position, in which fuel is delivered. A restoring spring acts on the switch lever, so that when the manual force diminishes, it is moved automatically back to the closed position.

So that during the filling process, which can take several minutes, it is not necessary for the user constantly to hold the restoring force of the restoring spring with his hand, the fuel pump nozzle according to the invention has a hold-open aid.

In the variant illustrated in FIGS. 1 and 2, the hold-open aid includes a latch member, which is designed as a pivotable lever 10. The lever 10 includes a first lever arm 12, which can co-operate with hold-open catches 14 firmly connected to the trigger guard 6, and a second lever arm 16, which is located near the switch lever 8 and can be operated by a user with the small finger of one hand, for example.

The lever 10 is pivotably mounted on the switch lever 8 on a swivel axis 18 and is biased by means of a spring 20 in the direction of a latched position, in which the lever 10 is illustrated in FIG. 2.

In this position, a latching surface 22 of the lever 10, which is formed on the first lever arm 12, co-operates with a hold-open catch 14 by frictional and positive engagement.

The latching surface 22 is conveniently formed with an undercut, in order to manage with a spring force of the spring 20 which is as small as possible and a small additional manual force acting on the second lever arm 16 of the lever 10, so that the switch lever 8 is held in the desired open position.

FIGS. 1 and 2 show three hold-open catches 14, the position of which is chosen such that a first hold-open catch (at the bottom in FIGS. 1 and 2) defines an open position of the pump nozzle, which corresponds to a small fuel throughput, a second hold-open catch (in FIGS. 1 and 2 the middle hold-open catch) defines an open position in which the switch lever is pulled further and the fuel pump nozzle has a medium fuel throughput, while a third hold-open catch (at the top in FIGS. 1 and 2) defines an open position in which the pump nozzle is virtually completely open and there is a maximum fuel throughput.

The lever 10 also has a release actuating surface 24, which slides along on a respective adjacent hold-open catch and swivels the lever (in an anti-clockwise direction in FIGS. 1 and 2) relative to the switch lever in the direction of a released position (FIG. 1) when there is an opening movement of the switch lever (upwards in FIGS. 1 and 2), so that the switch lever can be moved with no difficulty into any open position desired.

If the arrangement is such that the spring 18 biases the lever 10 in the direction of its latched position, this reduces the manual force required to hold the switch lever in a desired open position, without a finger force already having to be applied to the second arm 16 of the lever 10. In an arrangement of this kind, it is also possible to dispense with the second lever arm 16 completely. The lever arm 16 does, however, make it possible to eliminate completely the manual force required to hold the lever open, by operating it with the little finger or the like.

In an arrangement in which the spring 20 biases the lever 10 in the opposite direction to the latched position, on the other hand, finger force must be applied to the second lever arm 16 in a desired open position, and the lever 10 must be brought into engagement with a hold-open catch 14 and held in that position in order to achieve the desired reduction of the hold-open force of the switch lever. With this arrangement, it would be possible to dispense with the spring 20.

In any case, the switch lever 8 moves automatically to its closed position (at the very bottom in FIGS. 1 and 2) immediately after its release, irrespective of whether the lever 10 was in engagement with a hold-open catch in the previous open position or not. In the case of a spring biasing the lever towards the latched position, the spring is designed to be weaker than the force exerted by the restoring spring acting on the switch lever in order to restore the lever, so that the lever 10 under no circumstances holds the switch lever 8 open without any additional manual force acting.

FIG. 3 shows a variant of the invention, in which the latch member is designed not in the form of a pivotable lever, but in the form of a latching tappet 28 guided so as to be linearly movable. The latching tappet 28 is formed on a first end portion 29 pointing away from the switch lever 8 to co-operate with a counter-surface of the trigger guard 6 or of the pump nozzle housing 2 or with a selected hold-open catch. At an end portion facing the switch lever 8, the tappet 28 is connected in an articulated manner to a first lever member 30, which for its part is connected in an articulated manner at an articulation point 32 to a second lever member 34, which in turn is pivotably hinged to the switch lever 8. A restoring spring 36 acts between the switch lever 8 and the articulation point 32 in order to bias the latching tappet 28 in a release direction 38.

When the switch lever 8 is actuated, the articulation point 32 or the two adjacent lever members 30, 34 can be actuated in the direction of the arrow 40 in order in this way to move the latching tappet 28 in a latching direction 42 and to bring it into engagement with a hold-open catch—not shown—or in frictional engagement with an adjacent counter-surface of the trigger guard 6 or of the pump nozzle housing 2.

In this case too, the latching tappet 28 automatically returns in the direction 44 after the manual force has been released, thanks to the spring 36, and releases the switch lever 8 so that it can move back into its closed position.

The latching tappet 28 per se can be designed in itself as a spring-biased member, while an end portion 29 pointing away from the articulation point 32 can include a stopping slope so that, even when the articulation point 32 is urged fully in the direction 42, the switch lever 8 can be moved unhindered in the direction of an open position, it being possible for the latching tappet to slide across one or more hold-open catches because of the stopping slope and only come to latch against a hold-open catch in a desired, specific open position behind which the hold-open catch is located, where it holds the switch lever open when the articulation point 32 is kept depressed.

The lever members 30, 34 are clearly arranged such that a kind of toggle link is formed, which, when there is a manual force acting on the articulation point 32, generates a substantially greater force acting on the latching tappet 28.

LIST OF REFERENCE NUMERALS

2 Pump nozzle housing
4 Pump hose connection
6 Trigger guard
8 Switch lever
10 Lever
12 First lever arm
14 Hold-open catch
16 Second lever arm
18 Swivel axis
20 Spring
22 Latching surface
24 Release actuating surface
28 Latching tappet
29 End portion
30 First lever member
32 Articulation point
34 Second lever member
36 Restoring spring
38 Release direction
40, 42 Latching direction
44 Release direction

The invention claimed is:

1. A fuel pump nozzle for delivering comprising:

a manually operated switch lever (8) which is movable between a closed position, in which there is no delivery of fuel, and an open position, in which fuel is delivered, a restoring spring for biasing the switch lever (8) in the direction of the closed position and automatically returning the switch lever (8) to the closed position when the manual force applied declines, a hold-open aid (10), which reduces the force required to hold the switch lever (8) in at least one predetermined open position compared to the forces required to hold the switch lever (8) open in other open positions, holds the switch lever (8) open only if an additional manual force is applied, and after release of the additional manual force, releases the switch lever (8) so that it can move back into the closed position.

2. The fuel pump nozzle as claimed in claim 1, wherein the hold-open aid (10) reduces a necessary hold-open force in more than one predetermined open positions.

3. The fuel pump nozzle as claimed in claim 1, wherein the hold-open aid includes a hold-open latch member (10, 28) that can be moved between a latched position and a released position, which, in the latched position, can co-operate with at least one fixed hold-open catch (14) connected to a pump nozzle housing (2), the position of which defines the predetermined open position.

4. The fuel pump nozzle as claimed in claim 3, wherein the hold-open latch member (10, 28) is spring-biased towards or away from the latched position (20).

5. The fuel pump nozzle as claimed in claim 3, wherein the hold-open latch member is designed as a pivotable lever (10).

6. The fuel pump nozzle as claimed in claim 5, wherein the lever (10) includes a release actuating surface (24) for co-operating with the at least one hold-open catch (14).

7. The fuel pump nozzle as claimed in claim 5, wherein the lever (10) includes a latching surface (22) for co-operating with the at least one hold-open catch (14).

8. The fuel pump nozzle as claimed in claim 7, wherein the latching surface (22) is designed with an undercut.

9. The fuel pump nozzle as claimed in claim 3, wherein the hold-open latch member (10, 22) includes a hold-open portion (16, 28) that can be operated with one finger by a user.

10. The fuel pump nozzle as claimed in claim 9, wherein the hold-open portion is designed as a further lever arm (16) of the lever (10).

11. The fuel pump nozzle as claimed in claim 3, wherein the at least one fixed hold-open catch (14) comprises at least two hold-open catches disposed on a trigger guard (6) of a housing of the pump nozzle.

12. The fuel pump nozzle as claimed in claim 11, wherein a first hold-open catch of the at least two fixed hold-open catches (14) defines a predetermined open position with a minimum fuel throughput.

13. The fuel pump nozzle as claimed in claim 12, wherein a second hold-open catch of the at least two fixed hold-open catches (14) defines a predetermined open position with a medium fuel throughput.

14. The fuel pump nozzle as claimed in claim 13, wherein a third hold-open catch of the at least two fixed hold-open catches (14) defines a predetermined open position with a maximum fuel throughput.

* * * * *